US006053003A

United States Patent [19]

Song et al.

[11] Patent Number: 6,053,003

[45] Date of Patent: Apr. 25, 2000

[54] DEFROST WATER EVAPORATING APPARATUS IN A REFRIGERATOR

[75] Inventors: Joon-Ho Song; Woo-Yeub Choi, both of Kyeongki-Do, Rep. of Korea

[73] Assignee: Daewoo Electronics Co., Ltd., Seoul, Rep. of Korea

[21] Appl. No.: 09/116,576

[22] Filed: Jul. 16, 1998

[30] Foreign Application Priority Data

Jul. 30, 1997 [KR] Rep. of Korea ..... 97-20563
Jul. 30, 1997 [KR] Rep. of Korea ..... 97-36227

[51] Int. Cl.[7] ..... F25D 21/14

[52] U.S. Cl. ..... 62/285

[58] Field of Search ..... 62/277, 279, 285, 62/288, 305

[56] References Cited

U.S. PATENT DOCUMENTS

| | | | |
|---|---|---|---|
| 3,691,786 | 9/1972 | Anderson et al. | 62/279 |
| 4,023,380 | 5/1977 | Drouin . | |
| 4,250,717 | 2/1981 | Stone | 62/279 |
| 4,735,062 | 4/1988 | Wooley et al. | 62/277 |
| 5,271,241 | 12/1993 | Kim | 62/285 |
| 5,327,743 | 7/1994 | Coltrin | 62/279 |
| 5,664,430 | 9/1997 | Karman | 62/285 |

*Primary Examiner*—Henry Bennett
*Assistant Examiner*—M. Shulman
*Attorney, Agent, or Firm*—Pillsbury Madison & Sutro LLP

[57] ABSTRACT

Defrost water evaporating apparatus for a refrigerator. The apparatus has a plurality of bottom walls for separating a lower space from a refrigerating compartment, a base pan assembled to an underside of the refrigerator, a partition integrally formed at the base pan for partitioning the lower space into first and second space, a drain tube for guiding a defrost water into the first space, a condenser fixing structure for making the defrost water directly contact with a condenser, thereby evaporating the defrost water by a heat exchange with the condenser. The fixing structure has a couple of condenser fixing portions and an extending portion for increasing an actual heat exchange area of the condenser. By incorporating the apparatus with the refrigerator, the defrost water evaporating function is achieved by the base pan so that the uninsulated lower space of the refrigerator occupies a relatively small volume, and the defrost water collected in the lower space makes a direct contact with the condenser, thereby increasing a defrost water evaporating efficiency.

10 Claims, 4 Drawing Sheets

DEFROST WATER EVAPORATING APPARATUS IN A REFRIGERATOR

BACKGROUND OF THE INVENTION

1. Field of the Invention

The present invention relates generally to household refrigerators and, more particularly, to a base pan of a refrigerator for an evaporation of water formed from melted ice and frost.

2. Description of the Prior Art

Generally, refrigerators are used to store foodstuffs at the lower temperature in order to maintain freshness of the foodstuffs. They generally include a compressor which compresses and circulates a liquid-phase refrigerant, an evaporator which causes a pressure drop of the liquid-phase refrigerant so that the refrigerant is evaporated, thereby generating a chilled air, a condenser which condenses the vapor-phase refrigerant, thereby changing the vapor-phase refrigerant into liquid-phase refrigerant, and circulates the liquid-phase refrigerant to the compressor. The chilled air generated by the evaporator is introduced into a compartment by a fan.

Present day household refrigerators usually include in its lower portion an uninsulated space in which a compressor and a condenser are housed together with a drip pan. A drain tube is usually provided to discharge melted frost water into the pan where it receives heat from the condenser and the compressor unit in an amount sufficient to cause evaporation of the water collected in the pan at rates sufficient to keep the pan from overflowing.

In some cases, such as disclosed in U.S. Pat. No. 4,023,380, there is provided an improved molded plastic evaporation pan for collecting and evaporating the defrost water of a household refrigerator. Referring more particularly to FIGS. 1 and 2, the evaporation pan 10 is housed in the uninsulated lower compartment 12 of a refrigerator 14. This compartment is defined by sidewalls 16 and 18, rear wall 20, base 22, and by the upper dividing wall 24 adjacent the fresh food compartment (not shown) of the refrigerator. Together with the evaporation pan 10, a compressor 26 is housed in compartment 12. The defrosting components (not shown) of the refrigerator unit 14 accomplish periodic defrosting resulting in melted ice and frost which must be discharged to the evaporation pan. This discharging is achieved by means of a drain tube 28 made of flexible material directing the defrost water to the evaporation pan 10.

The pan 10 is formed from a single sheet of plastic material and has a bottom wall 30 and an upstanding continuous peripheral wall 32 forming front, rear and side walls. The bottom wall 30 includes a centrally located recessed portion 34 of circular configuration. Disposed adjacent the recessed portion 34 are four mounting posts 37 which are integrally formed with the bottom wall 30 of the pan. The portion of bottom wall 30 adjacent the mounting posts is thicker somewhat to provide reinforcement as shown in FIG. 2. A series of annular lugs 40 are inserted over the vertical posts. The outside wall of each annular lugs 40 is shaped with a groove 46 to receive a portion of supporting plate 48 on which is mounted the compressor 26. The evaporation pan 10 is fixedly mounted to the base 22 of the refrigerator and includes one or more wells 54 which serve to receive the defrost water discharged through the drain tube 28.

However, the conventional evaporation pan as above described has disadvantages in that the water collected in the pan does not makes contact with the heat radiating component such as the compressor and condenser, and the supporting plate is interposed on a heat transfer path, so an evaporating efficiency thereof decreases and a steam generated from the evaporation of the defrost water dispersed in the lower compartment may lead to rusting of the components installed therein.

SUMMARY OF THE INVENTION

The present invention is intended to overcome the above-described disadvantages. Therefore, it is an object of the present invention to provide a defrost water evaporating apparatus in which a defrost water evaporating function is achieved by a base pan of a refrigerator so that an uninsulated lower space of the refrigerator occupies a relatively small volume, and in which the defrost water collected in the lower space makes a direct contact with a condenser, thereby increasing a defrost water evaporating efficiency and a condenser cooling efficiency.

In order to achieve the above object of the present invention, there is provided a defrost water evaporating apparatus for a refrigerator, which comprises:

- first, second and third bottom walls installed at a bottom of a refrigerating compartment for forming a lower space below the refrigerating compartment;
- a base pan assembled to an underside of the refrigerator so as to confine the lower space together with the first, second and third bottom walls and both sidewalls of the refrigerator;
- a first means for partitioning the lower space into a first space for receiving a defrost water and a second space for receiving a compressor;
- a second means for guiding the defrost water generated from an exterior of an evaporator installed in an evaporator compartment located at a rear portion of the refrigerator into the first space and for transferring a radiation of the compressor to the defrost water; and
- a third means for evaporating the defrost water by a heat exchange between a condenser and the defrost water collected in the first space by the second means, the defrost water being in direct contact with the condenser.

According to a preferred embodiment of the present invention, the first bottom wall forwardly extends from a predetermined position at a rear wall of the refrigerator in such a manner that the first bottom wall is spaced vertically apart from the compressor installed in the second space, the second bottom wall extends from a front edge of the first bottom wall in a downwardly inclined direction so as to separate the second space from the first space with the first means, and the third bottom wall extends forwardly from a front edge of the second bottom wall so as to define an upper wall of the first space, the first, second and third bottom walls thereby separating the first and second space from the refrigerating compartment.

Meanwhile, the first bottom wall is formed with a hole for penetrating a conduit which guides a refrigerant discharged from the compressor to the evaporator.

The first means includes a partition vertically extending from the base pan so as to make contact with a junction portion between the second and third bottom walls, the partition being formed at an upper portion thereof with a hole for penetrating a one end portion of the condenser so as to be connected to the compressor.

The second means includes a drain tube which is communicated at an upper end thereof with a lower portion of the evaporator compartment, downwardly extends through the rear wall of the refrigerator, the first, second and third bottom walls so as to communicate with an upper portion of the first space, the drain tube guiding the defrost water falling from the exterior of the evaporator in the evaporator compartment into the first space, a portion of the drain tube which passes through the first and second bottom walls adjacent to the compressor installed in the second space so that the drain tube absorbs a radiation of the compressor and transfers the radiation to the defrost water, thereby increasing a temperature of the defrost water.

The third means includes at least one fixing means for fixing the condenser in the first space, the fixing means formed at predetermined positions of a portion of the base pan defining a bottom of the first space, the fixing means increases a heat exchange area between the condenser and the defrost water collected into the first space by the second means, thereby facilitating an evaporation of the defrost water.

According to a preferred embodiment of the present invention, each fixing means includes a couple of condenser fixing portions for fixing the condenser and an extending portion for increasing an actual outer surface of the condenser, the extending portion unites confronting portions of the condenser fixing portions.

Each condenser fixing portion includes a couple of vertical posts upwardly extending from the base pan, the vertical posts being formed at upper ends thereof confronting each other with bending portions, each of which is bent toward the confronting vertical post, the condenser being press-fitted between the vertical posts when the condenser is fixed to the base pan.

According to a preferred embodiment of the present invention, the extending portion is formed by uniting two adjacent vertical posts of the condenser fixing portions adjacent to each other, the extending portion serving as a heat exchange pin which increases the outer surface of the condenser contacting with the posts, thereby facilitating a heat exchange between the condenser and the defrost water.

According to a preferred embodiment of the present invention, the third means includes three fixing means.

According to a preferred embodiment of the present invention, the base pan is formed at an upper portion of a side thereof with a grill portion for allowing a steam generated by an evaporation of the defrost water to be drawn out of the refrigerator.

As described above, in the defrost water evaporating apparatus in accordance with the present invention, the defrost water evaporating function is achieved by the base pan of the refrigerator so that the uninsulated lower space of the refrigerator occupies a relatively small volume, and the defrost water collected in the lower space makes direct contact with the condenser, thereby increasing a defrost water evaporating efficiency and a condenser cooling efficiency.

BRIEF DESCRIPTION OF THE INVENTION

The above object and other advantages of the present invention will become more apparent by describing in detail a preferred embodiment thereof with reference to the attached drawings in which.

DETAILED DESCRIPTION OF THE INVENTION

Hereinafter, a defrost water evaporating apparatus in accordance with a preferred embodiment of the present invention will be explained in more detail with reference to the accompanying drawings.

Figure 1:
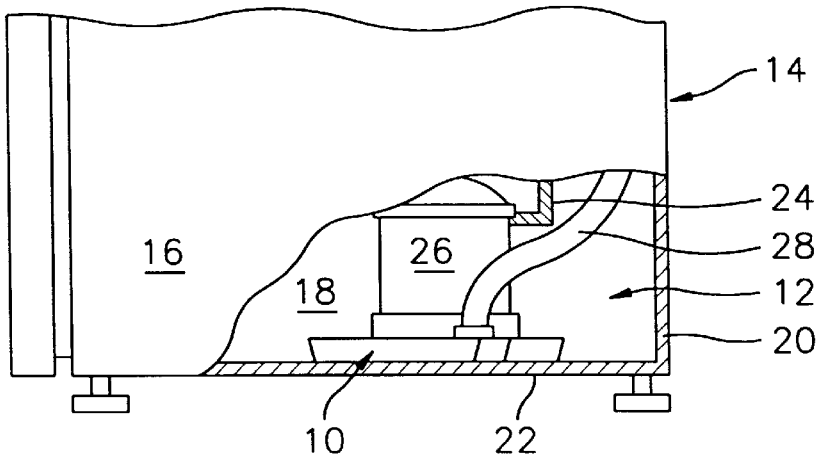
FIG. 1 (PRIOR ART)
FIG. 1 is a fragmentary view of a lower portion of a refrigerator showing a conventional evaporation pan.
Figure 2:
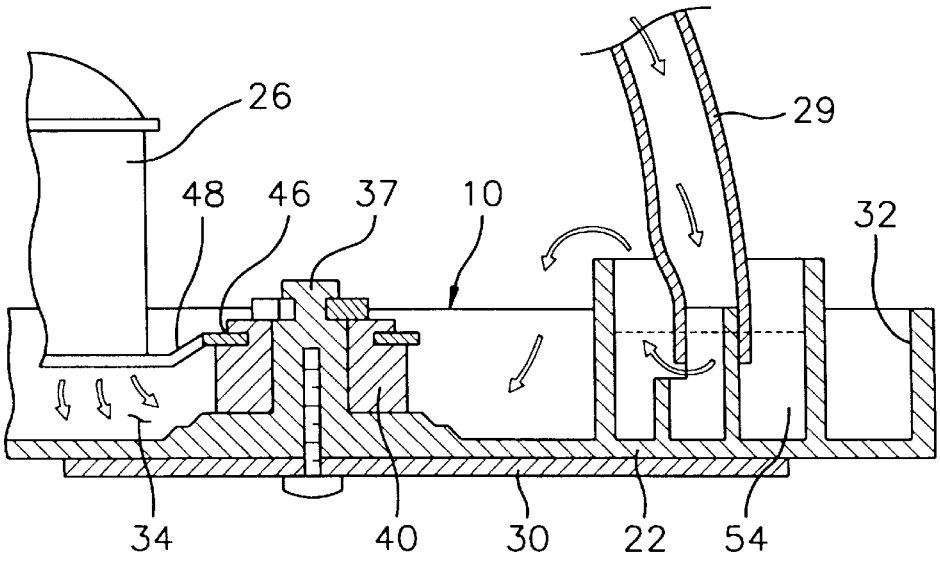
FIG. 2 (PRIOR ART)
FIG. 2 is an elevational sectional view of the evaporation tray shown in FIG. 1.
Figure 3:
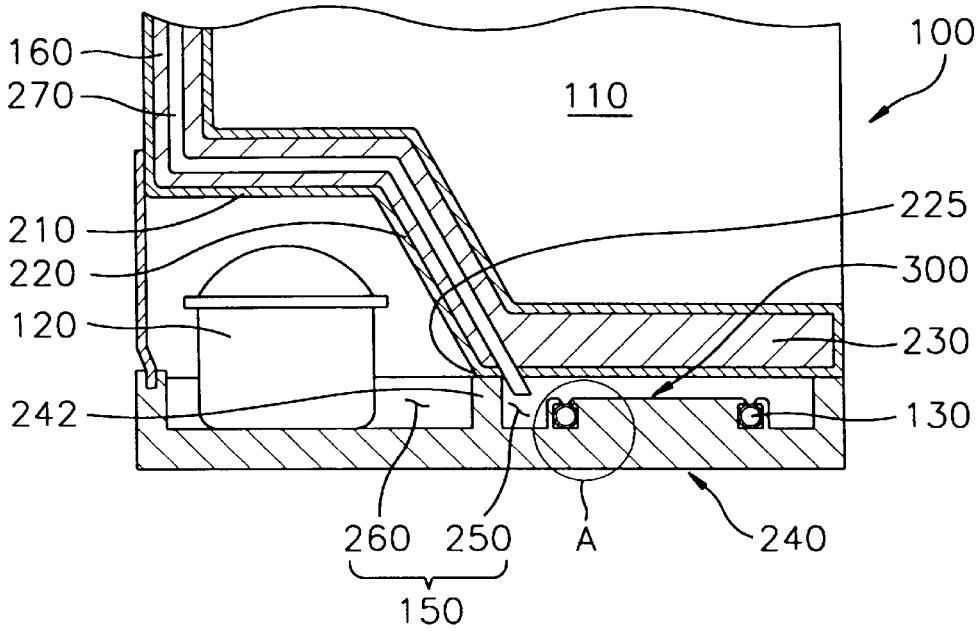
FIG. 3 is a sectional view of an inner structure of an uninsulated lower space of a refrigerator in accordance with the present invention.

FIG. 3 is a sectional view of an inner structure of an uninsulated lower space 150 of a refrigerator 100 in accordance with the present invention.

Referring to FIG. 3, a refrigerating compartment 110 is separated from lower space 150 by first, second and third bottom walls 210, 220 and 230 installed at a bottom of refrigerating compartment 110. A base pan 240 is assembled to an underside of the refrigerator 100 so as to confine the lower space 150 together with the first, second and third bottom walls 210, 220 and 230 and both sidewalls (not shown) of the refrigerator 100.

In order to partition the lower space 150 into a first space 250 for receiving a defrost water and a second space 260 for receiving a compressor 120, a partition 242 vertically extends from the base pan 240 so as to make contact with a junction portion between the second and third bottom walls 220 and 230. The partition 242 is formed at an upper portion thereof with a hole 244, as shown in FIG. 5, for penetrating a one end portion of the condenser 130 so as to be connected to the compressor 120.

According to a preferred embodiment of the present invention, the first bottom wall 210 forwardly extends from a predetermined position at a rear wall 160 of the refrigerator 100 in such a manner that the first bottom wall 210 is spaced vertically apart from the compressor 120 installed in the second space 260. The second bottom wall 220 extends from a front edge of the first bottom 210 wall in a downwardly inclined direction so as to separate the second space 260 from the first space 250 with the partition 242. The third bottom wall 230 extends forwardly from a front edge of the second bottom 220 wall so as to define an upper wall of the first space 250. Thus, the first, second and third bottom walls separates the first and second spaces 250 and 260 from the refrigerating compartment 110.

Figure 5:
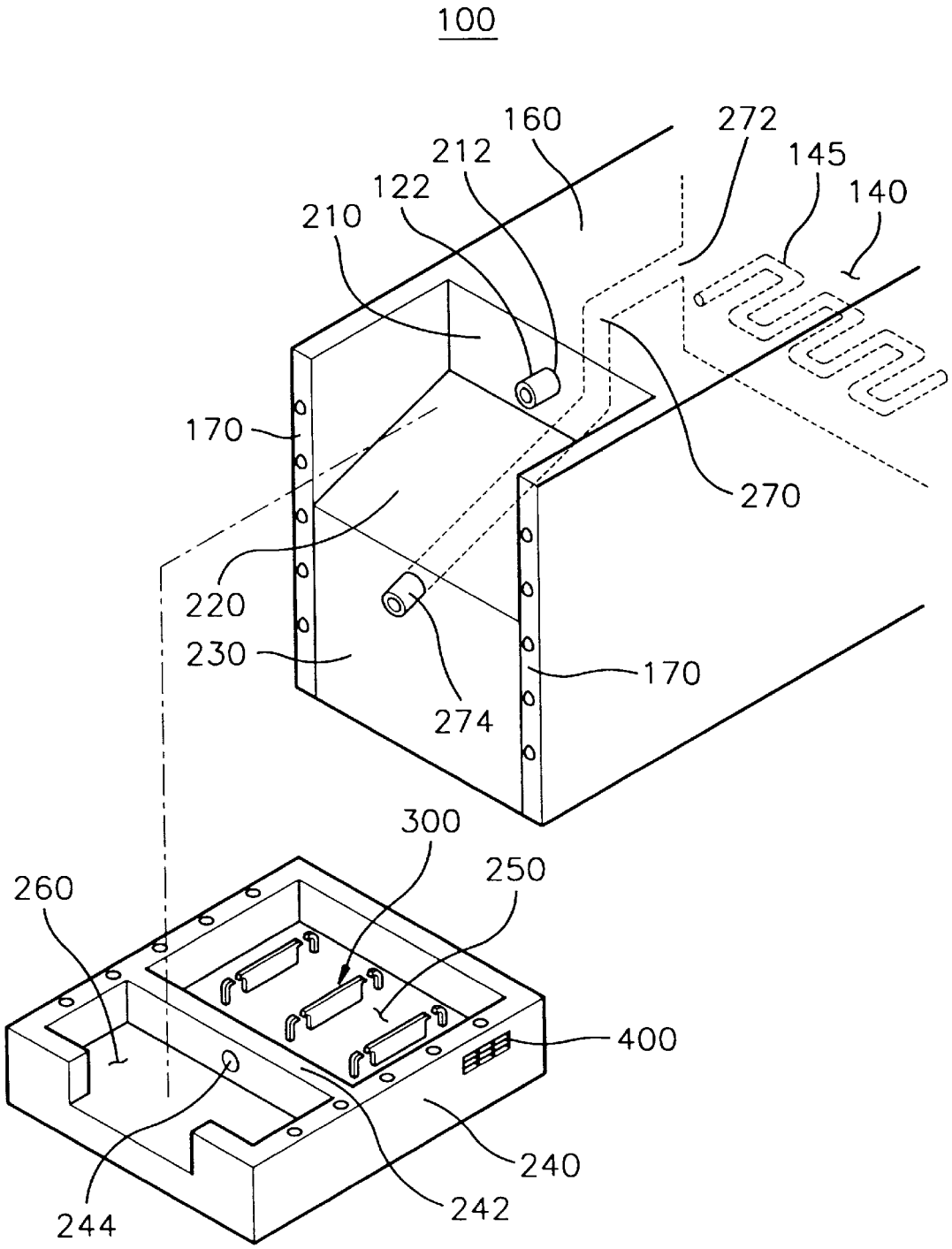
FIG. 5 is a perspective view of a defrost water evaporating apparatus in accordance with an embodiment of the present invention.

Meanwhile, as shown in FIG. 5, the first bottom wall 210 is formed with a hole 212 for penetrating a conduit 122 which guides a refrigerant discharged from the compressor 120 to an evaporator 145.

Also, to guide the defrost water generated from an exterior of the evaporator 145 installed in an evaporator compartment 140 located at a rear portion of the refrigerator 100 (shown in FIG. 5) into the first space 250 and simultaneously to transfer a radiation of the compressor 120 to the defrost water, a drain tube 270 is provided. Drain tube 270 is communicated at an upper end thereof with a lower portion of the evaporator compartment 140, and downwardly extends through the rear wall 160 of the refrigerator 100, the first, second and third bottom walls 210, 220 and 230 so as to communicate with an upper portion of the first space 250. The drain tube 270 guides the defrost water falling from the exterior of the evaporator 145 in the evaporator compartment 140 into the first space 250. A portion of the drain tube 270 which passes through the first and second bottom walls 210 and 220 is adjacent to the compressor 120 positioned in the second space 260 so that the drain tube 270 absorbs a radiant of the compressor 120 and transfers the radiant to the defrost water, thereby preheating the defrost water.

To make the defrost water contact directly with the condenser 130 and to evaporate the defrost water by a heat exchange between a condenser 130 and the defrost water collected in the first space 250 by the drain tube 270, at least one fixing structure 300 for fixing the condenser 130 in the first space 250 is formed at predetermined positions of a portion of the base pan 240 defining a bottom of the first space 250. The fixing structure 300 increases a heat exchange area between the condenser 130 and the defrost water collected into the first space 250, thereby facilitating an evaporation of the defrost water.

Figure 6:
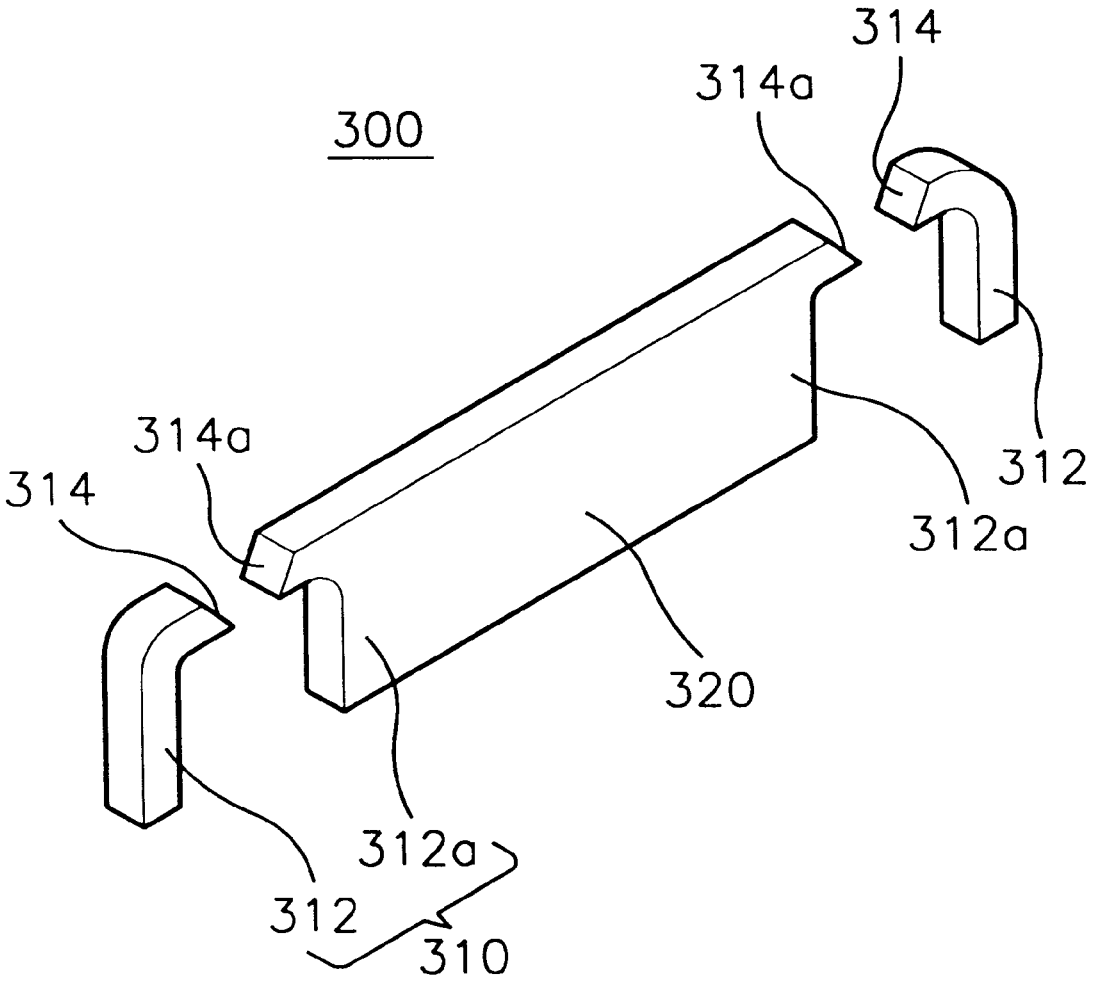
FIG. 6 is an enlarged view of a condenser fixing structure shown in FIG. 5.

According to a preferred embodiment of the present invention, specially referring to FIG. 6, each fixing structure 300 includes a couple of condenser fixing portions 310 for fixing the condenser 130, and an extending portion 320 for increasing an actual outer surface of the condenser 130 which unites confronting portions of the condenser fixing portions 310.

Each condenser fixing portion 310 includes a couple of vertical posts 312 and 312*a* upwardly extending from the base pan 240. The vertical posts 312 and 312*a* are formed at upper ends thereof confronting each other with bending portions 314 and 314*a*, each of which is bent toward the confronting vertical post, so that later, the condenser 130 is press-fitted between the vertical posts 312 and 312*a* when the condenser 130 is to be fixed to the base pan 240.

Figure 4:
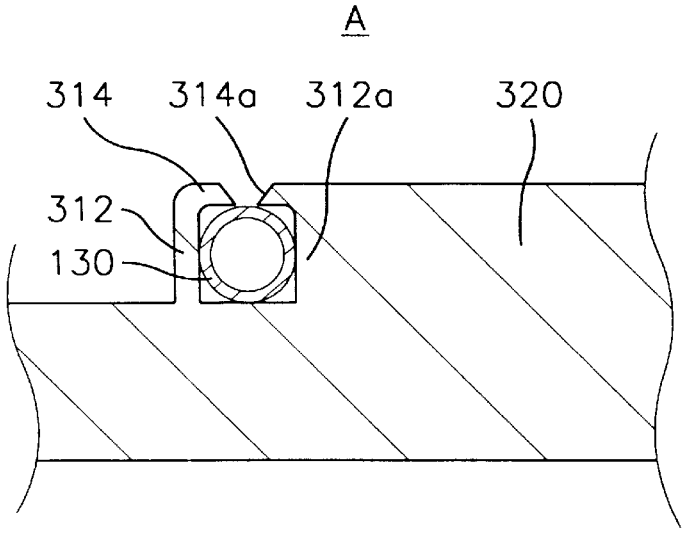
FIG. 4 is an enlarged view of a portion indicated by "A" in FIG. 3.

As shown in FIG. 4, according to a preferred embodiment of the present invention, the extending portion 320 is formed by uniting two adjacent vertical posts 312*a* of the condenser fixing portions 310 adjacent to each other. Thus, the extending portion 320 serves as a heat exchange pin which increases the outer surface of the condenser 130 contacting with the posts 312 and 312*a*, thereby facilitating a heat exchange between the condenser 130 and the defrost water.

According to a preferred embodiment of the present invention, the fixing structure 300 includes three fixing structures.

On the other hand, according to a preferred embodiment of the present invention, the base pan 240 is formed at an upper portion of a side thereof with a grill portion 400 for allowing a steam generated by an evaporation of the defrost water to be drawn out of the refrigerator 100. Grill portion 400 is densely formed to prevent foreign stuffs from flowing into the lower space 150.

Hereinafter, the assembling process and the operation of the defrost water evaporating apparatus of the present embodiment will be described with reference to the accompanying drawings.

At first, condenser 130 is press-fitted into each couple of posts 312 and 312*a* formed in first space 250 in a corrugated manner. Condenser 130 is connected at a one end thereof to second end 274 of drain tube 270 penetrating through third bottom wall 230, and is connected at the other end thereof to compressor 120 in second space 260 through hole 244 formed at partition 242.

Meanwhile, the outlet (not shown) of compressor 120 is connected to the end of conduit 122 penetrating first bottom wall 210 through hole 212.

In this state where condenser 130 and compressor 120 are installed in the uninsulated lower space, base pan 240 is assembled to the both sidewalls 170 of refrigerator 100 by screws (not shown).

In the state as above described, refrigerator 100 is operated while carrying out predetermined cooling cycles.

While in a defrosting mode, the ice formed at the exterior of evaporator 145 installed in evaporator compartment 140 located at the rear portion of refrigerator 100 is melted into the defrost water by a defrost heater (not shown) so as to fall downwardly. The falling defrost water is received in first space 250 through drain tube 270 which is communicated with the lower portion of evaporator compartment 140, and makes a direct contact with condenser 130 fixed in first space 250 so that a heat exchange is occurred therebetween, resulting in the evaporation of the defrost water. At this time, while the defrost water passing through the portion of drain tube 270 which is disposed through first and second bottom walls 210 and 220 adjacent to compressor 120, the defrost water absorbs the radiant of the compressor 120 so as to be pre-heated, thereby being promoted in its evaporation in first space 250.

Finally, the evaporating defrost water by exchanging heat with condenser 130 in first space 250 is drawn out of refrigerator 100 through grill portion 400 formed at a side of base pan 240.

As described above, in the defrost water evaporating apparatus in accordance with the present invention, the defrost water evaporating function is achieved by the base pan of the refrigerator so that the uninsulated lower space of the refrigerator occupies a relatively small volume, and the defrost water collected in the lower space makes a direct contact with the condenser, thereby increasing a defrost water evaporating efficiency and a condenser cooling efficiency.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A defrost water evaporating apparatus for a refrigerator, which comprises:

first, second and third bottom walls installed at a bottom of a refrigerating compartment for forming a lower space below the refrigerating compartment;

a base pan assembled to an underside of the refrigerator so as to confine the lower space together with the first, second and third bottom walls and both sidewalls of the refrigerator;

a first means for partitioning the lower space into a first space for receiving a defrost water and a second space for receiving a compressor, the first bottom wall extending forward from a rear wall of the refrigerator such that the first bottom wall is vertically spaced apart from the compressor, the second bottom wall being inclined and extending downward from the first bottom wall so as to separate the second space from the first space together with the first means, and the third bottom wall extending forward from the second bottom wall so as to define an upper wall of the first space, the first, second and third bottom walls separating the first and the second spaces from the refrigerating compartment;

a second means for guiding the defrost water generated from an exterior of an evaporator installed in an evaporator compartment located at a rear portion of the refrigerator into the first space and for transferring a radiation of the compressor to the defrost water; and a third means for evaporating the defrost water by a heat exchange between a condenser and the defrost water collected in the first space by the second means, the defrost water being in direct contact with the condenser.

2. The apparatus as recited in claim 1, wherein the first bottom wall is formed with a hole for penetrating a conduit which guides a refrigerant discharged from the compressor to the evaporator.

3. The apparatus as recited in claim 1, wherein the first means includes a partition vertically extends from the base pan so as to make contact with a junction portion between the second and third bottom walls, the partition being formed at an upper portion thereof with a hole for penetrating a one end portion of the condenser so as to be connected to the compressor.

4. The apparatus as recited in claim 1, wherein the second means includes a drain tube which is communicated at an upper end thereof with a lower portion of the evaporator compartment, downwardly extends through the rear wall of the refrigerator, the first, second and third bottom walls so as to communicate with an upper portion of the first space, the drain tube guiding the defrost water falling from the exterior of the evaporator in the evaporator compartment into the first space, a portion of the drain tube which passes through the first and second bottom walls being adjacent to the compressor installed in the second space so that the drain tube absorbs a radiation of the compressor and transfers the radiation to the defrost water, thereby increasing a temperature of the defrost water.

5. The apparatus as recited in claim 1, wherein the third means includes at least one fixing means for fixing the condenser in the first space, the fixing means formed at predetermined positions of a portion of the base pan defining a bottom of the first space, the fixing means increases a heat exchange area between the condenser and the defrost water collected into the first space by the second means, thereby facilitating an evaporation of the defrost water.

6. The apparatus as recited in claim 5, wherein each fixing means includes a couple of condenser fixing portions for fixing the condenser and an extending portion for increasing an actual outer surface of the condenser, the extending portion unites confronting portions of the condenser fixing portions.

7. The apparatus as recited in claim 6, wherein each condenser fixing portion includes a couple of vertical posts upwardly extending from the base pan, the vertical posts being formed at upper ends thereof confronting each other with bending portions, each of which is bent toward the confronting vertical post, the condenser being press-fitted between the vertical posts when the condenser is fixed to the base pan.

8. The apparatus as recited in claim 7, wherein the extending portion is formed by uniting two adjacent vertical posts of the condenser fixing portions adjacent to each other, the extending portion serving as a heat exchange pin which increases the outer surface of the condenser contacting with the posts, thereby facilitating a heat exchange between the condenser and the defrost water.

9. The apparatus as recited in claim 5, wherein the third means includes three fixing means.

10. The apparatus as recited in claim 1, wherein the base pan is formed at an upper portion of a side thereof with a grill portion for allowing a steam generated by an evaporation of the defrost water to be drawn out of the refrigerator.

* * * * *